US006122848A

United States Patent [19]

Fukuda et al.

[11] Patent Number: 6,122,848

[45] Date of Patent: Sep. 26, 2000

[54] HYDRAULIC DRIVE TYPE WORKING VEHICLE

[75] Inventors: Masao Fukuda, Kawagoe; Hiroaki Inoue, Hiratsuka; Nobuo Matsuyama, Sakado, all of Japan

[73] Assignee: Komatsu Ltd., Tokyo, Japan

[21] Appl. No.: 09/205,055

[22] Filed: Dec. 3, 1998

[30] Foreign Application Priority Data

Dec. 5, 1997 [JP] Japan ..... 9-350194

[51] Int. Cl.[7] ..... E02F 5/00

[52] U.S. Cl. ..... 37/382; 37/414; 60/388; 60/393; 90/358 R

[58] Field of Search ..... 37/348, 382, 902, 37/414; 60/327, 388, 393, 419; 91/358 R

[56] References Cited

U.S. PATENT DOCUMENTS

| | | | |
|---|---|---|---|
| 5,081,838 | 1/1992 | Miyaoka et al. | 60/444 |
| 5,178,510 | 1/1993 | Hanamoto et al. | 414/694 |
| 5,277,269 | 1/1994 | Ichimura et al. | 180/306 |
| 5,392,539 | 2/1995 | Hirata et al. | 37/348 |
| 5,446,979 | 9/1995 | Sugiyama et al. | 37/348 |

FOREIGN PATENT DOCUMENTS 9-32045 2/1997 Japan .

*Primary Examiner*—Eileen Dunn Lillis
*Assistant Examiner*—Gary S. Hartmann
*Attorney, Agent, or Firm*—Sidley & Austin

[57] ABSTRACT

A hydraulic drive type working vehicle, with speedy responsiveness in an excavating operation, includes: a pouring changeover valve (10), which is switchable between (a) a pouring position, wherein pressurized oil of a travel hydraulic circuit (5) is poured into a working machine hydraulic circuit (8), and (b) a shutoff position, wherein the travel hydraulic circuit (5) and the working machine hydraulic circuit (8) are isolated from each other; a first changeover valve (16), which is switchable from its shutoff position to its communicating position when the oil pressure of the travel hydraulic circuit (5) exceeds a predetermined oil pressure; a pouring command switch (14); and a second changeover valve (17), which is connected in series with the first changeover valve (16) and which is switchable from its shutoff position to its communicating position upon receipt of a pouring command from the pouring command switch (14); and wherein the pouring changeover valve (10) is switchable to the pouring position when the oil pressure of the travel hydraulic circuit (5) exceeds the predetermined oil pressure and the pouring command is outputted.

8 Claims, 9 Drawing Sheets

FIG.8 PRIOR ART

| No. | PROCESS | CONTENT | TIME (SECOND) |
|---|---|---|---|
| ① | ADVANCING | ADVANCE WITH NO LOAD FROM CORNER OF V-SHAPE IN EARTH AND SAND DIRECTION | ABOUT 5 |
| ② | EXCAVATING | EXCAVATE WITH MAXIMUM DRIVING FORCE, 100% WORKING MACHINE FORCE (MAXIMUM OIL PRESSURE 210Kg/cm$^2$), 20% TO 30% WORKING MACHINE FLOW RATE | ABOUT 4 |
| ③ | BACKING | BACK LOADED WITH EXCAVATED EARTH AND SAND TO ADVANCE STARTING POSITION ① | ABOUT 5 |
| ④ | ADVANCING | ADVANCE WITH DRIVING FORCE OF TRAVELING RESISTANCE, 70% OR LESS WORKING MACHINE FORCE (LOAD LIFTING FORCE), 100% WORKING MACHINE FLOW RATE TO APPROACH DUMP TRUCK OR HOPPER | ABOUT 5 |
| ⑤ | DISCHARGING EARTH AND SAND | DISCHARGE LOADED EARTH AND SAND INTO DUMP TRUCK OR HOPPER | ABOUT 1 |
| ⑥ | BACKING | RETURN WITH NO LOAD TO ADVANCE STARTING POSITION ① AND COMPLETE 1 CYCLE | ABOUT 5 |
| TOTAL | | 1 CYCLE OF V-SHAPED LOADING OPERATION | ABOUT 25 |

HYDRAULIC DRIVE TYPE WORKING VEHICLE

TECHNICAL FIELD

The present invention relates to a hydraulic drive type working vehicle which is provided with a working machine.

BACKGROUND ART

A V shaped loading operation, which is a typical excavating pattern of a working machine, for example, a wheel loader, will be explained with FIGS. 7 and 8. An excavating process, occupying about 4 seconds out of about 25 seconds per cycle, determines the excavating performance as to how quickly and strongly a bucket edge, which is an example of a working machine, is penetrated into earth and sand in about 1 second in which the operation "from penetrating into the ground to separating from the ground surface" is conducted. Accordingly, an optimization of the force balance of a bucket edge and an improvement in speed (responsiveness) of about 1 second are important.

A first prior art (which corresponds to FIG. 7 in Japanese Laid-open Patent No. 9-32045) will be explained with reference to FIG. 9. The oil pressure, supplied to the working machine cylinder 9 from the working machine pump 6 via the working machine hydraulic circuit 8, increases only to the set pressure of the working machine relief valve 38 during an excavating operation. Therefore, there are situations in which the force for lifting a bucket is in short supply such that the bucket can not be lifted. In such cases, the oil pressure of the working machine cylinder 9 operates on an unloading valve 66 to unload the working machine hydraulic circuit 8, and at the same time a pressure sensor 69 detects that the pressure of the working machine hydraulic circuit 8 is not less than a predetermined pressure, whereby an operator moves a switch 68 to its ON position. Thus, when a signal from the pressure sensor 69 and an ON signal from the switch 68 are inputted to the AND circuit 67, the solenoid 65*a* of the on-off valve 65 is electrified so that the on-off valve 65 is switched to its communicating position. Hence, the oil pressure of the working machine cylinder 9 operates on the working machine assisting valve 64 via the conduit 71 to switch the working machine assisting valve 64 to its communicating position. Consequently, the high discharge pressure of the travel pump 2 is supplied to the working machine cylinder 9 by way of the check valve 72, the working machine assisting valve 64, and the conduit 71, whereby the bucket can be lifted by the increased thrust.

In a second prior art for increasing the working machine force, the working machine pump is changed from a gear pump to a plunger pump and the oil pressure is raised, for examples from 210 kg/cm$^2$ to 320 kg/cm$^2$, thus increasing the working machine force.

In a third prior art for increasing the driving force of the vehicle, the loss in oil pressure is reduced by unloading the whole or a part of an unnecessary pumped quantity at the time of operation with a multistage pump, for example, or the loss in oil pressure is reduced by reducing the discharged quantity from a variable displacement pump. Thus, the driving force of the vehicle is increased by the reduced oil pressure loss, and the excavating performance is improved.

However, the aforesaid prior arts have the following disadvantages.

(1) In the first prior art, when a signal from the pressure sensor 69 and an ON signal from the switch 68 are inputted to the AND circuit 67, the solenoid 65*a* of the on-off valve 65 is electrified so that the on-off valve 65 is switched to its communicating position, and the working machine assisting valve 64 is switched to its communicating position. However, considerable time is needed before the working machine assisting valve 64 is switched to its communication position, after the signal from the pressure sensor 69 and the ON signal from the switch 68 are inputted to the AND circuit 67. Therefore, there is a disadvantage in that it is difficult to attain both the optimization of the force balance of the bucket edge and the improvement in speed (responsiveness) in about 1 second, thereby lowering the excavating performance.

(2) Moreover in the first prior art, while the working machine assisting valve 64 is switched to its communicating position, the oil pressure of the working machine cylinder 9 operates on the unloading valve 66 to unload the working machine hydraulic circuit 8. Therefore, there is a merit in that the whole engine torque turns into driving torque of the travel pump 2, thus increasing the tractive force of the vehicle. However, there is a disadvantage in that, in slippery working sites and the like, tire slips occur, thus increasing the abrasion of the tires and lowering the excavating operational efficiency.

(3) In the second prior art, the pressure is always raised so that reinforcement of power lines, such as an accelerator and the like, is needed. In addition, the plunger pump has a higher cost as compared with the gear pump. When the plunger pump, for example, is used, there is a disadvantage in that the merits, produced by using the more expensive plunger pump, are not utilized if the pressure is usually at a low pressure value (e.g., 210 kg/cm$^2$) and turns into a high pressure value (e.g., 320 kg/cm$^2$) when necessary, but not frequently with variable relief and the like.

(4) The multistage pump and the variable displacement pump used in the third prior art increase the cost.

SUMMARY OF THE INVENTION

The present invention is made to eliminate the aforesaid disadvantages of the prior arts, and its object is to provide a hydraulic drive type working vehicle with a simple configuration and a speedier responsiveness in an excavating operation which enables an improvement in the excavating performance and the operational efficiency, and a reduction in the fuel consumption.

In a first aspect of the present invention a hydraulic drive type working vehicle is characterized in that a hydraulic drive type working vehicle, having a travel hydraulic circuit for traveling the vehicle and a working machine hydraulic circuit for driving a working machine and for receiving pressurized oil of the travel hydraulic circuit, which exceeds the pressure of the oil of the working machine hydraulic circuit, into the working machine hydraulic circuit as necessary, includes:

- a pilot pressure source;
- a pouring changeover valve, having a first pilot pressure receiving portion for receiving a pilot pressure from the pilot pressure source, and being switchable between a pouring position, wherein pressurized oil of the travel hydraulic circuit is poured into the working machine hydraulic circuit, and a shutoff position, wherein the travel hydraulic circuit and the working machine hydraulic circuit are isolated from each other;
- a first changeover valve, disposed between the pilot pressure source and the first pilot pressure receiving portion, having a second pilot pressure receiving portion for receiving pressurized oil of the travel hydraulic circuit, and being switchable from its shutoff position to its communicating position when the oil pressure of the travel hydraulic circuit exceeds a predetermined oil pressure;

pouring command switch for outputting a pouring command; and a second changeover valve, connected in series with the first changeover valve between the pilot pressure source and the first pilot pressure receiving portion, and being switchable from its shutoff position to its communicating position upon receipt, at a solenoid portion, of a pouring command from the pouring command switch; and wherein the pouring changeover valve is switched to its pouring position when the oil pressure of the travel hydraulic circuit exceeds the predetermined oil pressure and the pouring command is outputted.

According to the aforesaid configuration, the first changeover valve and the second changeover valve are connected in series between the pilot pressure source and the first pilot pressure receiving portion of the pouring changeover valve. When either one of the first changeover valve and the second changeover valve is already switched to its communicating position and the other valve is switched to its communicating portion, pilot pressure immediately operates on the first pilot pressure receiving portion from the pilot pressure source. Thus, the pouring changeover valve is switched to its pouring position to pour oil at the high pressure of the travel hydraulic circuit into the working machine hydraulic circuit, thereby increasing the working machine force instantaneously. When the pressure of the travel hydraulic circuit exceeds the predetermined pressure and a command is sent from the pouring command switch, the working machine force increases instantaneously. Consequently, with the optimization of the force balance between the tractive force and the lifting force of a bucket edge and the improvement in the responsiveness in a short time of about 1 second, the penetrating force of the bucket edge increases and the excavating performance is greatly improved. A gear pump can be used for a travel pump or a working machine pump. As it is not necessary to use a plunger pump, the costs are lowered.

In addition, a pouring releasing means, disposed between the pouring command switch and the solenoid portion for interrupting the pouring command during an operation of the working machine, can be provided.

According to the aforesaid configuration, when the pouring releasing means interrupts a command from the pouring command switch during the operation of the working machine, the pouring changeover valve is switched to its position, where the travel pump and the working machine hydraulic circuit are isolated from each other, to connect the working machine pump to the working machine hydraulic circuit. Therefore, an operator does not need to perform an operation for interrupting the command from the pouring command switch; oil discharged from the travel pump is automatically supplied to the travel hydraulic circuit, and oil discharged from the working machine pump is supplied to the working machine hydraulic circuit, which makes the usual operation possible.

Further, the operation of the working machine can be at least one of a tilting operation of a bucket provided on the working machine and an operation of a boom operating lever of the working machine returning to a neutral position.

According to the aforesaid configuration, the penetration of the bucket into the ground during an excavation is effected by pouring oil, discharged from the travel pump, into the working machine hydraulic circuit at the time of the excavation. After the penetration, the operator returns the boom operating lever to the neutral position. The command from the pouring command switch is interrupted during the operation of the boom returning to the neutral position or during the bucket tilting operation at the time of tilting the bucket and scooping earth and sand into the bucket. As a result, the pouring changeover valve is switched to its position where the travel pump and the working machine hydraulic circuit are isolated from each other, thereby making the usual operation possible. A pouring releasing operation is no longer necessary, which improves the operability and the working performance.

Furthermore, the hydraulic drive type working vehicle can include:

a sensor for detecting at least one of the bucket tilting operation and the operation of the boom operating lever returning to the neutral position; and a controller for inputting a signal from the sensor and for outputting to the pouring releasing means a signal for interrupting the pouring command.

According to the aforesaid configuration, when the controller inputs a detection signal of either one of the tilting operation and the neutral position returning operation, the controller outputs a signal to the pouring releasing means for interrupting the pouring command. The adoption of the electronic control, described above, simplifies the configuration.

In a second aspect of the present invention, a hydraulic drive type working vehicle has a travel hydraulic circuit, for traveling the vehicle, and a working machine hydraulic circuit, for driving a working machine and for receiving pressurized oil of the travel hydraulic circuit, which exceeds the pressure of the oil of the working machine hydraulic circuit, into the working machine hydraulic circuit as necessary, includes:

a working machine pump for discharging pressurized oil into the working machine hydraulic circuit;

a travel pump for discharging pressurized oil into the travel hydraulic circuit;

a load adjusting means for setting the pressure of oil discharged from the working machine pump at a predetermined load condition in the range of an unload condition to an optional load condition, and for setting the driving torque of the travel pump at a predetermined value; and a pouring changeover valve which is switchable between a pouring position, wherein oil of the working machine pump is discharged into the load adjusting means and pressurized oil of the travel hydraulic circuit is poured into the working machine hydraulic circuit, and a shutoff position, wherein oil of the working machine pump is discharged into the working machine hydraulic circuit and wherein the travel hydraulic circuit and the working machine hydraulic circuit are isolated from each other.

According to the aforesaid configuration, when the pouring changeover valve is in its pouring position, pressurized oil of the travel hydraulic circuit is poured into the working machine hydraulic circuit and oil of the working machine pump is discharged into the load adjusting means. The pressure of the oil discharged from the working machine pump is set in the predetermined loaded condition and then the consumption torque of the working machine pump is set, whereby the driving torque of the travel pump can be adjusted. The working machine force increases by pouring high pressure oil of the travel hydraulic circuit into the working machine hydraulic circuit as described above, thus facilitating excavation, shortening the excavating time and the cycle time, and improving the fuel consumption. Moreover, since the driving torque of the travel pump can be adjusted to optionally reduce the tractive torque of the vehicle at the time of excavation on slippery road surfaces and the like, tire slips are prevented, abrasion of tires is reduced, and the excavating operation is facilitated. Accordingly, the tractive force can be selected according to the working sites and the objects to be operated, whereby the excavating operational efficiency is improved and the engine torque can be effectively used. A gear pump can be used for the travel pump or the working machine pump, thus lowering costs.

In addition, the load adjusting means can include:

- a load means for allowing the pressure of oil discharged from the working machine pump to be set at optional load;
- a load changeover valve, which is switchable between a load position, wherein the working machine pump is connected to the load means, and an unload position, wherein the working machine pump is unloaded; and
- a mode selecting switch, for outputting a switching command, for switching the load changeover valve to its load position.

According to the aforesaid configuration, when the mode selecting switch is not operated, the whole engine torque turns into driving torque of the travel pump, since discharge oil from the working machine pump is unloaded so that there is no consumption torque of the working machine pump. When the mode selecting switch is operated and discharge oil from the working machine pump is connected to the load means to be in the predetermined loaded condition, the driving torque of the travel pump is reduced by the consumption torque of the working machine pump. Therefore, at the time of excavation on slippery road surfaces and the like, the driving torque of the travel pump can be adjusted to optionally reduce the tractive torque of the vehicle with only the operation of the mode selecting switch. Thus, tire slips are prevented, and excavating operational efficiency is improved. As described above, the tractive force can be selected according to the working sites and the objects to be operated with only the operation of the mode selecting switch.

Furthermore, the load means can allow load, ranging from an unload condition to the predetermined load condition, to be set continuously or at predetermined steps.

According to the aforesaid configuration, an operation can be conducted with the most suitable tractive force for the working sites and the objects to be operated, for example, by continuously adjusting the tractive force of the vehicle, whereby the excavating operational efficiency is improved. In addition, since the tractive force of the vehicle can be set stepwise as necessary, adjustment is simple.

BRIEF DESCRIPTION OF THE DRAWINGS

FIG. 8 is a diagram showing the time required for each process in the operation in FIG. 7.

BEST MODE FOR CARRYING OUT THE INVENTION

Preferred embodiments of a hydraulic drive type working vehicle according to the present invention will now be described in detail with reference to the attached drawings.

Figure 1:
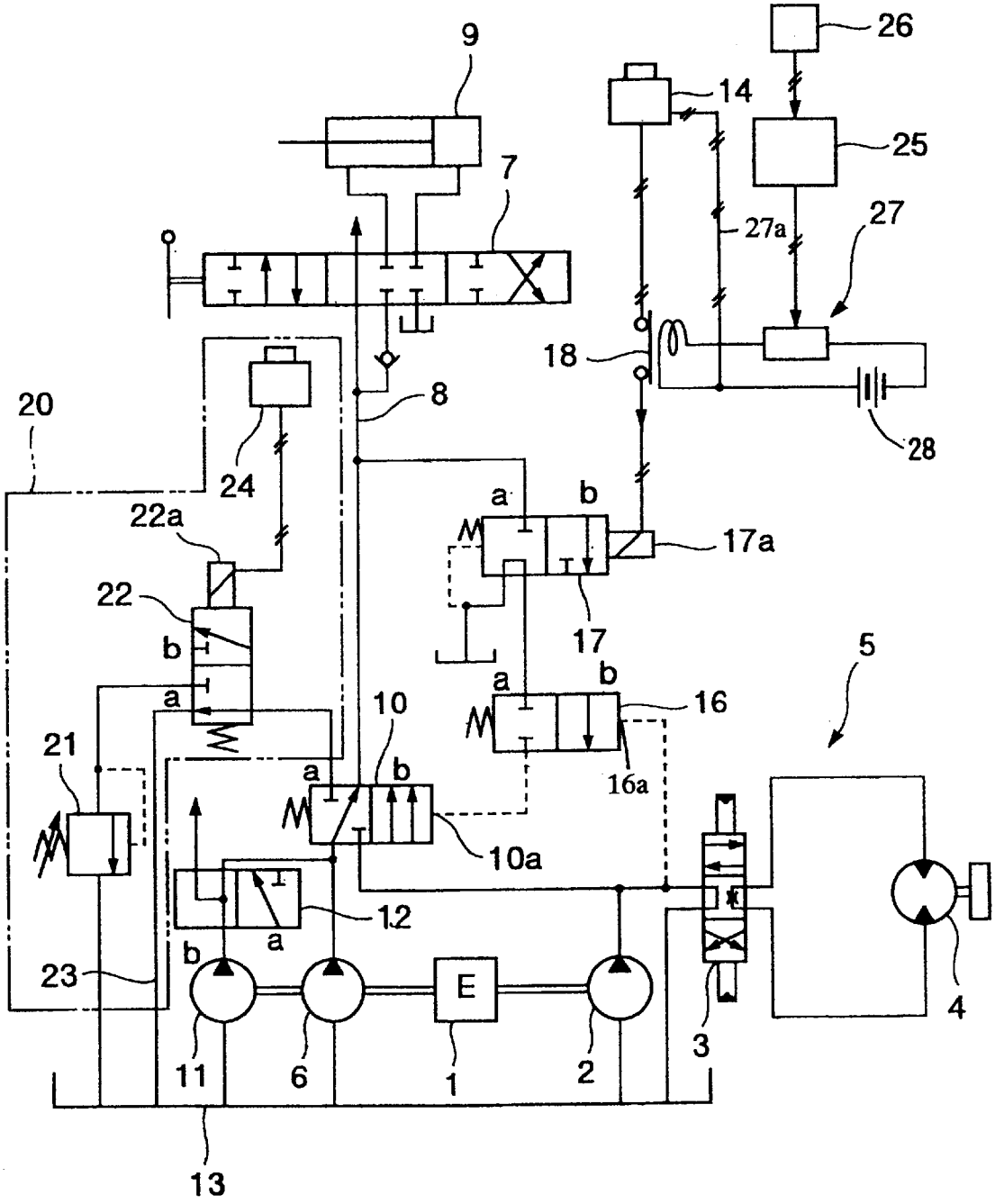
FIG. 1 is an oil hydraulic circuit diagram showing a first embodiment of a hydraulic drive type vehicle according to the present invention.

A first embodiment will be explained with reference to FIG. 1. A travel hydraulic circuit 5 for the vehicle is composed by connecting a travel motor 4 to a travel pump 2 via a travel operating valve 3. A working machine hydraulic circuit 8 is composed by connecting a working machine cylinder 9, such as a bucket cylinder attached to the vehicle, to a working machine pump 6 and a pouring changeover valve 10 via a working machine operating valve 7. A discharge conduit of the travel pump 2, diverging from the travel hydraulic circuit 5, is connected to a first inlet of the pouring changeover valve 10. A discharge conduit of the working machine pump 6 is connected to a second inlet of the pouring changeover valve 10 and joins a discharge conduit of a steering pump 11 via a joining valve 12. The travel pump 2, the working machine pump 6, and the steering pump 11 are driven by an engine 1.

A first outlet of the pouring changeover valve 10 is connected to the working machine hydraulic circuit 8, and a second outlet of the pouring changeover valve 10 is connected to an inlet of a load changeover valve 22. A first outlet of the load changeover valve 22 is connected to a tank 13 via a drain line 23, and a second outlet of the load changeover valve 22 is connected to the tank 13 via a load means 21 which is capable of setting the discharge oil from the working machine pump 6 at the optional load condition. The load changeover valve 22 is an electromagnetic type changeover valve which can switch between an unload position a, wherein the pouring changeover valve 10 is unloaded to the drain line 23, and a load position b, wherein the pouring changeover valve 10 is connected to the load means 21. The load changeover valve 22 is switched to its unload position a when the solenoid 22*a* is demagnetized, and is switched to its load position b when the solenoid 22*a* is magnetized. When a mode selecting switch 24, connected to the solenoid 22*a*, is made to be ON, the solenoid 22*a* is magnetized. A load adjusting means 20 is composed of the load means 21, the load changeover valve 22 with the solenoid 22*a*, the drain conduit 23, and the mode selecting switch 24. Incidentally, a variable relief valve, a pressure reducing valve, or the like, can be used as the load means 21. In addition, the load can be set continuously or stepwise.

A pilot pressure type first changeover valve 16 and an electromagnetic type second changeover valve 17 are connected in series between the working machine hydraulic circuit 8 and a pilot pressure receiving portion (a first pilot pressure receiving portion) 10*a* of the pouring changeover valve 10. Accordingly, the oil pressure of the working machine hydraulic circuit 8 serves also as a pressure source of pilot oil pressure operating on the pilot pressure receiving portion 10*a*.

A pouring command switch 14 is connected to a solenoid 17*a* of the second changeover valve 17 via a pouring releasing means 18. An electric circuit 27, in which the pouring releasing means 18 and a power source 28 are disposed in series, is connected to a sensor 26 via a controller 25. In the electric circuit 27, a line 27*a* is connected between the pouring command switch 14 and the junction of the anode side of the power source 28 and the pouring releasing means 18. When a signal is inputted to the controller 25 from the sensor 26, which detects the operation of a boom operating lever to a neutral position, the controller 25 outputs a signal to the electrical circuit 27 to apply current from the power source 28 to the coil of the pouring releasing means. With this electrification of the coil of the pouring releasing means 18, the switch of the pouring releasing means 18 is opened (namely, OFF), and thus the solenoid 17*a* of the second changeover valve 17 is demagnetized and the second changeover valve 17 is switched to its position a (the shutoff position). When the pouring releasing means 18 is OFF, the second changeover valve 17 remains in its position a, even if the pouring command switch 14 is operated (namely, ON).

Meanwhile, when the aforesaid detection signal from the sensor 26 is not inputted to the controller 25, the coil of the pouring releasing means 18 is not electrified, since the electric circuit 27 to the power source 28 is open. Therefore, the switch of the pouring releasing means 18 is closed and ON. Under this situation, when the pouring command switch 14 is operated (that is, ON) and the line 27*a* and the solenoid 17*a* are connected, the solenoid 17*a* is magnetized by the power source 28, and the second changeover valve 17 is switched to its position b (the communicating position).

Oil pressure of the travel hydraulic circuit 5 operates on a pilot pressure receiving portion (a second pilot pressure receiving portion) 16*a* of the first changeover valve 16. Specifically, when the pressure of the travel hydraulic circuit 5 is above a predetermined pressure, the first changeover valve 16 is switched to its position b (the communicating position); and when the pressure of the travel hydraulic circuit 5 is below the predetermined pressure, the first changeover valve 16 is switched to its position a (the shutoff position).

When both the first and second changeover valves 16 and 17 are in their positions b (the communicating positions), the pilot pressure operates on the pilot pressure receiving portion 10*a* of the pouring changeover valve 10 to switch the pouring changeover valve 10 to its position b (a communicating position). If at least one of the first and second changeover valves 16 and 17 is in its position a (the shutoff position), the pilot pressure is shut off from the pilot pressure receiving portion 10*a* of the pouring changeover valve 10, so that the pouring changeover valve 10 is switched to its position a (the shutoff position). Thus, the pouring changeover valve 10 is switchable between (a) its usual position a, wherein the travel pump 2 is isolated from the working machine hydraulic circuit 8 and the working machine pump 6 communicates with the working machine hydraulic circuit 8, and (b) the pouring position b, wherein the travel pump 2 communicates with the working machine hydraulic circuit 8 and the working machine pump 6 communicates with the load changeover valve 22.

Operation in the first embodiment will be explained with reference to FIGS. 1 and 4. In step S1, when a signal is not inputted to the controller 25 from the sensor 26, which detects the returning operation of the boom operating lever to the neutral position, the switch of the pouring releasing means 18 is closed and the procedure starts. In step S2, when the pouring command switch 14 is not closed, the procedure returns to step S2 again. If the pouring command switch 14 closes (or is already closed), the solenoid 17*a* of the second changeover valve 17 is magnetized to switch the second changeover valve 17 to its position b (the communicating position), and the procedure advances to step S3.

In step S3, when the pressure P1 of the travel hydraulic circuit 5 is lower than a predetermined high pressure Pa (e.g., 210 kg/cm$^2$), that is, when P1<Pa, the procedure advances to step S4. In step S4, the first changeover valve 16 is in its position a (the shutoff position) due to P1<Pa. Hence, pilot pressure does not operate on the pilot pressure receiving portion 10*a* of the pouring changeover valve 10, whereby the pouring changeover valve 10 remains in its usual position a. As a result, the usual operation is performed in which the travel pump 2 discharges oil into the travel hydraulic circuit 5, and the working machine pump 6 discharges oil into the working machine hydraulic circuit 8.

In step S3, when the pressure P1 of the travel hydraulic circuit 5 is not less than the predetermined high pressure Pa, that is, when P1≧Pa, the procedure advances to step S5. In step S5, the first changeover valve 16 is switched to its position b (the communicating position) due to P1≧Pa. Since the second changeover valve 17 is already in its position b (the communicating position) as described above, pilot pressure immediately operates on the pilot pressure receiving portion 10*a* of the pouring changeover valve 10 to switch the pouring changeover valve 10 to its pouring position b. Thus, discharge oil, having a pressure above the predetermined high pressure Pa, is poured from the traveling pump 2 into the working machine hydraulic circuit 8, while oil from the working machine pump 6 is discharged into the load changeover valve 22.

In step S6, when the mode selecting switch 24 is not closed (that is, OFF), the procedure advances to step 7. In step 7, the solenoid 22*a* of the load changeover valve 22 is demagnetized since the mode selecting switch 24 is OFF; therefore, the load changeover valve 22 is in its position a. Thus, the working machine pump 6 is unloaded.

In step S6, when the mode selecting switch 24 is closed (that is, ON), the procedure advances to step S8 in which the solenoid 22*a* is magnetized and thus the load changeover valve 22 is switched to its position b. Accordingly, a predetermined load is given to the working machine pump 6 by the load means 21. A common variable relief valve, which can optionally and manually change the set pressure according to the slipping conditions of the tires, is used as the load means 21. Incidentally, a tire slip detector (not shown), connecting with the load means 21, can be provided; and a signal from the tire slip detector can be inputted to the load means 21. In addition, when the tires tend to slip, the set pressure of the load means 21 can be raised so as to reduce the traction force. This set pressure can be set in a continuous manner or stepwise.

As described above, if the pouring command switch 14 is operated to switch the second changeover valve 17 to its position b (the communicating position), pilot pressure operates on the pilot pressure receiving portion 10*a* to switch the pouring changeover valve 10 to its pouring position b when only the first changeover valve 16 is switched to its position b (the communicating position) when the pressure P1 of the travel hydraulic circuit 5 exceeds the predetermined high pressure Pa. Thereby, high pressure oil of the travel hydraulic circuit 5, which is set at a maximum pressure Pb (e.g., 250 kg/cm$^2$) is poured into the working machine hydraulic circuit 8, whereby the lifting force of the working machine increases instantaneously.

Meanwhile, when the pressure P1 of the travel hydraulic circuit 5 is above the predetermined high pressure Pa and below the maximum pressure Pb, the first changeover valve 16 is switched to its position b (the communicating position). If the first changeover valve 16 is switched as described above, high pressure oil of the travel hydraulic circuit 5 is poured into the working machine hydraulic circuit 8 only when the pouring command switch 14 is operated (namely, ON operation) to switch the second changeover valve 17 to its position b (the communicating position), whereby the lifting force of the working machine increases instantaneously.

As described above, the optimization of the balance between the tractive force and the lifting force at the bucket edge and the responsiveness in a short time of about 1 second are improved, thereby increasing the penetrating force of the bucket edge and greatly improving the excavating performance.

After the penetration of the bucket edge is completed in about 1 second, the operator returns the boom operating lever to the neutral position, tilts the bucket, and scoops earth and sand into the bucket. The sensor 26 detects the returning operation to the neutral position, and the detection signal is inputted to the controller 25. As described above, the controller 25 outputs a signal for closing the electric circuit 27 to open the switch of the pouring releasing means 18, whereby the second changeover valve 17 is switched to its position a (the shutoff position). Thus, the pouring changeover valve 10 is switched from its position b (the communicating position) to its position a (the shutoff position), thereby making the usual operation possible. In this way, the pouring releasing means 18 is opened with the returning operation of the boom operating lever to the neutral position. Consequently, an opening operation, of the pouring releasing means 18 by the operator, becomes unnecessary; and, moreover, the possibility of the operator forgetting the opening operation is avoided.

Incidentally, although the returning operation of the boom operating lever to the neutral position is detected to open the pouring releasing means 18 in the first embodiment, this detection can be based on a reduction in the pilot pressure for a boom operating valve. In addition, as the detection required for opening the pouring releasing means 18, the detection of a tilting operation of a bucket operating lever or the detection of a bucket tilting operation, based on an increase in the pilot pressure for a bucket operating valve, are also applicable.

Figure 4:
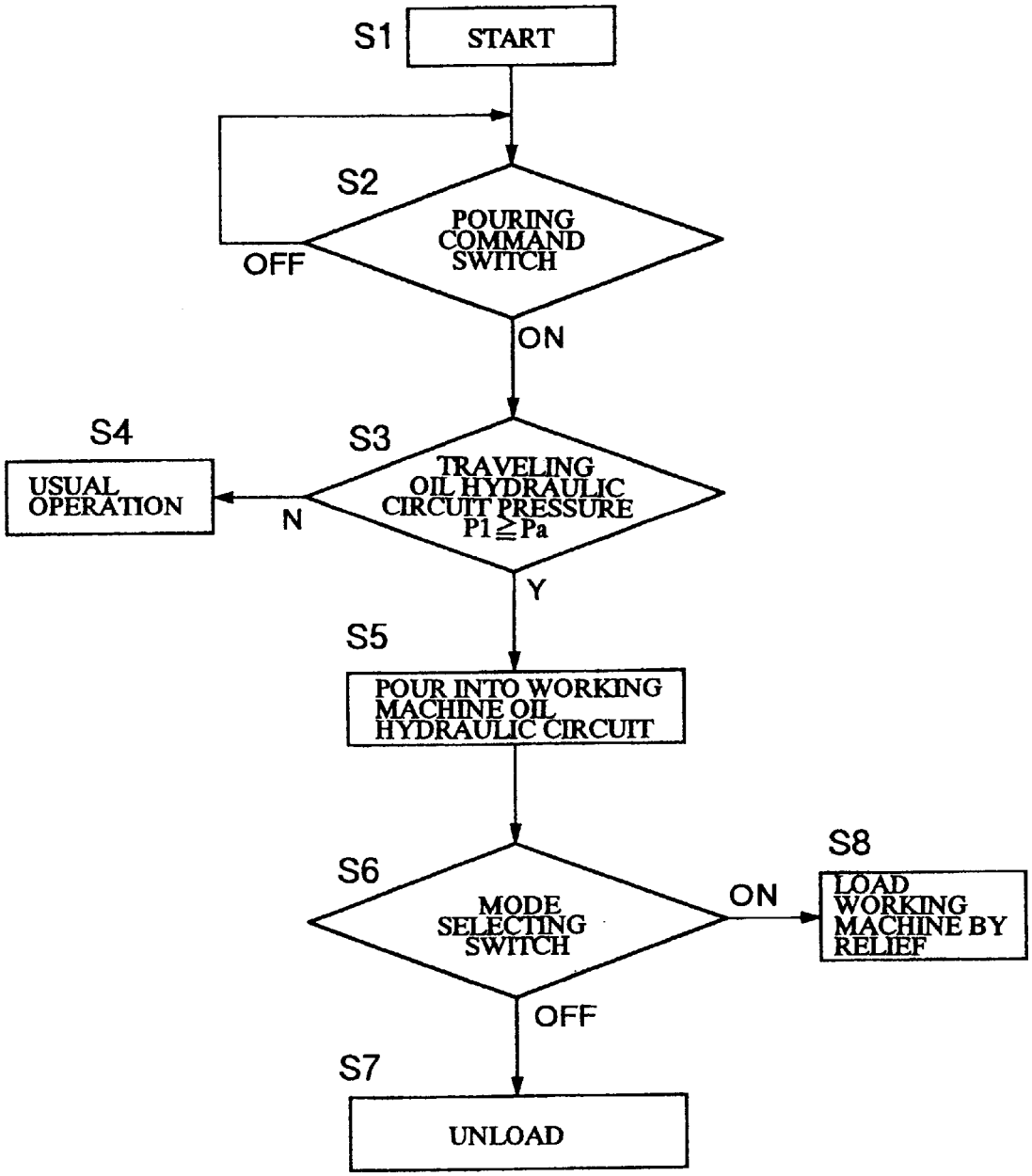
FIG. 4 is a flow chart according to the first embodiment of the present invention.
Figure 5:
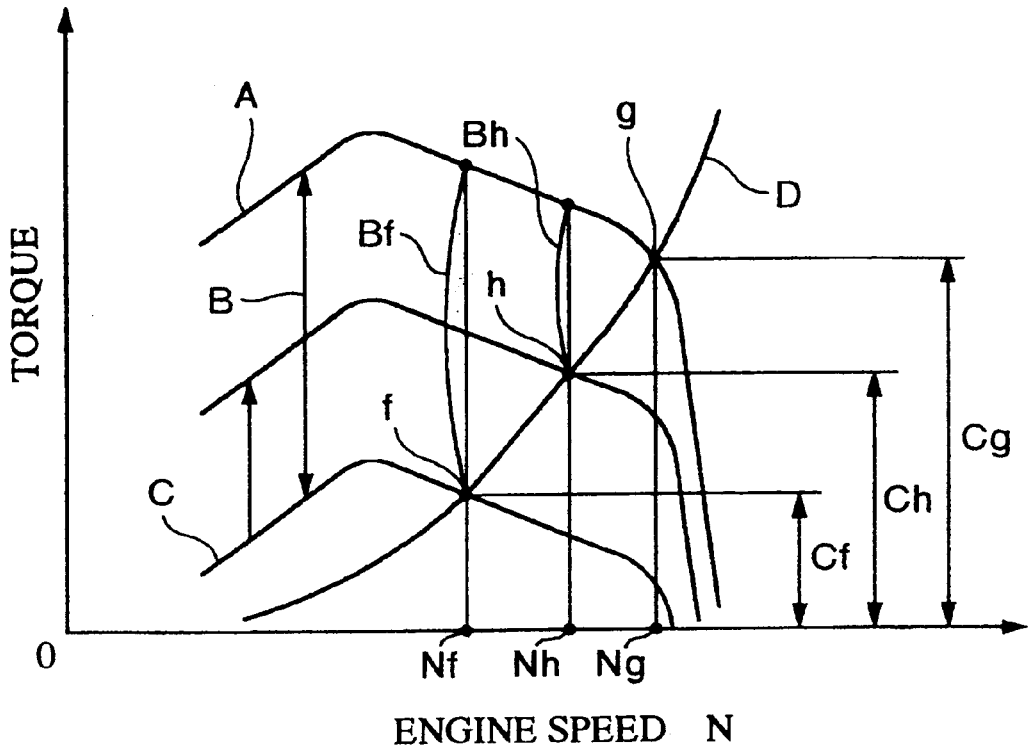
FIG. 5 is a diagram showing the relationship between each torque and engine speed according to the first embodiment of the present invention.

In FIG. 5, the engine speed N is represented by the horizontal axis; torque is represented by the vertical axis; and the engine torque A, the consumption torque B of the load means 21, the driving torque C of the travel pump 2, and the absorption torque D of a torque converter are shown. Steps S7 and S8 in FIG. 4 will be explained in detail with reference to FIG. 5. In step S7, the working machine pump 6 is unloaded, thereby the consumption torque B=0. Consequently, the whole engine torque A becomes equivalent to the driving torque C of the travel pump 2. In this case, a matching point of the driving torque C and the absorption torque D is a point g. At the matching point g, the driving torque of the travel pump 2 is Cg, and the engine speed is Ng. Accordingly, when the working machine pump 6 is unloaded, the total of the tractive torque and the working machine torque is equivalent to the driving torque Cg of the travel pump 2, whereby the tractive torque increases with an increase in the driving torque Cg.

Step S8 is the case where the consumption torque B of the load means 21 is set at Bh. In this case, the matching point of the driving torque C and the absorption torque D is a point h, where the driving torque of the travel pump 2 is Ch and the engine speed is Nh. Therefore, both the driving torque and the engine speed decrease as against those when the working pump 6 is unloaded. The tractive torque in this case also decreases according to the driving torque Ch. In addition, if the consumption torque B of the load means 21 is increased to Bf, the matching point of the driving torque C and the absorption torque D becomes a point f where the driving torque of the travel pump 2 is Cf and the engine speed is Nf, the driving torque and the engine speed decreasing more than those at the matching point h. Accordingly, the tractive torque at the matching point f further decreases according to the driving torque Cf.

At the time of an excavation on a non-slippery road surface and the like, the working machine pump 6 is unloaded to increase the tractive torque and the working machine torque as described above, thereby improving the penetrating performance of the bucket. Conversely, at the time of an excavation on a slippery road surface and the like, tire slips are reduced if the consumption torque B of the load means 21 is set at a predetermined value according to how slippery the road surface is. Thus, abrasion of the tires is prevented, the excavating operation is facilitated, and the excavating efficiency is improved.

Figure 6A:
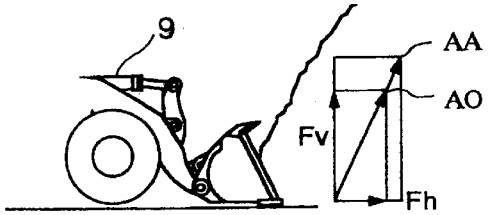
FIG. 6A to FIG. 6C are diagrams showing the force balance of a bucket edge according to the first embodiment of the present invention, with FIG. 6A showing a point of time when excavation starts, FIG. 6B showing a point of time when the excavation has progressed, and FIG. 6C showing a point of time when the excavation has further progressed.
Figure 6B:
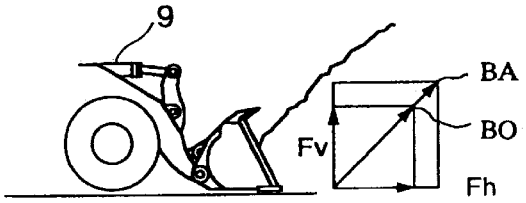

The balance between the tractive force Fh and the lifting force Fv in an excavating process (see FIG. 7) of a V shaped loading operation by a wheel loader will be explained with reference to FIGS. 6A to 6D. As shown in FIG. 6A, first the boom operating lever is manipulated to lower the bucket to a ground surface, and a partial operation of the accelerator and a full operation of the boom operating lever are conducted in the state of penetrating the bucket into the earth and sand while traveling at a medium speed. Here the partial operation of the accelerator signifies a partial operation as against an acceleration to the full and corresponds to the medium tractive force Fh. The full operation of the boom operating lever signifies an operation for maximizing the boom force and for obtaining the large lifting force Fv. The aforesaid operating condition corresponds to an excavating point A0 in FIG. 6D.

In order for the bucket to penetrate further, the wheel loader advances, after changing the acceleration from the partial operation to the full operation. However, if the pressure of the working machine cylinder 9 remains at the maximum pressure (e.g., 210 kg/cm$^2$) of the working machine pump 6 at this time, the relationship between the tractive force Fh and the lifting force Fv changes to a point C0 via a matching point B0 as shown in FIG. 6D. While the tractive force Fh increases, the lifting force Fv decreases. Therefore, in the present embodiment, discharge oil from the travel pump 2, which has a higher pressure than that from the working machine pump 6, can be instantaneously poured into the working machine hydraulic circuit 8 as necessary, for example, at each point A0, B0, or C0. Thus, a decrease in the lifting force Fv with an increase in the tractive force Fh is prevented, and the balance of the tractive force Fh and the lifting force Fv operating on the bucket edge is improved. The procedure for pouring the discharge oil from the travel pump 2 will be explained infra.

When the bucket needs to be penetrated further from the excavating point A0, the pouring command switch 14 is closed, as in step S2 in FIG. 4. If the pressure P1 of the travel hydraulic circuit, 5 is not less than the predetermined high pressure Pa (e.g., 210 kg/cm$^2$) at this time, the pouring changeover valve 10 is in its position b (the pouring position), and the discharge oil from the travel pump 2 (at the maximum oil pressure, e.g., 250 kg/cm$^2$), which has a higher pressure than that from the working machine pump 6, is poured into the working machine hydraulic circuit 8, thereby increasing the lifting force Fv. If the pump 6 is unloaded and the whole engine torque A is equivalent to the driving torque Cg of the traveling pump 2 at the time of the aforesaid pouring, it is set to move from the excavating point A0 to a point BB. Specifically, even if the tractive force Fh increases, the lifting force Fv is maintained so as not to be lowered, thus increasing the penetrating force of the bucket. Meanwhile, when the consumption torque of the working machine pump 6 is set at Bh at the time of pouring, the relationship between the tractive force Fh and the lifting force Fv is set to move the excavating point A0 to a point AA as shown in FIG. 6A and FIG. 6D. The section between the point AA and the point BB is a section which varies according to a set value of the consumption torque Bh of the working machine pump 6.

When the bucket needs to be penetrated further from the matching point B0, the operator closes the pouring command switch 14. Thus, the relationship between the tractive force Fh and the lifting force Fv is moved from the matching point B0 to a point CC in the same way as in the case where the pouring command switch 14 is closed at the excavating point A0 when the working machine pump 6 is unloaded, thereby increasing the tractive force Fh while maintaining the lifting force Fv. As a result, the penetrating force of the bucket edge is increased. When the consumption torque of the working machine pump 6 is set at Bh, the relationship between the tractive force Fh and the lifting force Fv is moved from the matching point B0 to a point BA. The section between the point BA and the point CC is a section which varies according to a set value of the consumption torque Bh of the working machine pump 6.

Figure 6C:
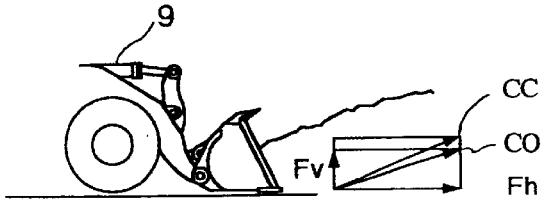
Figure 6D:
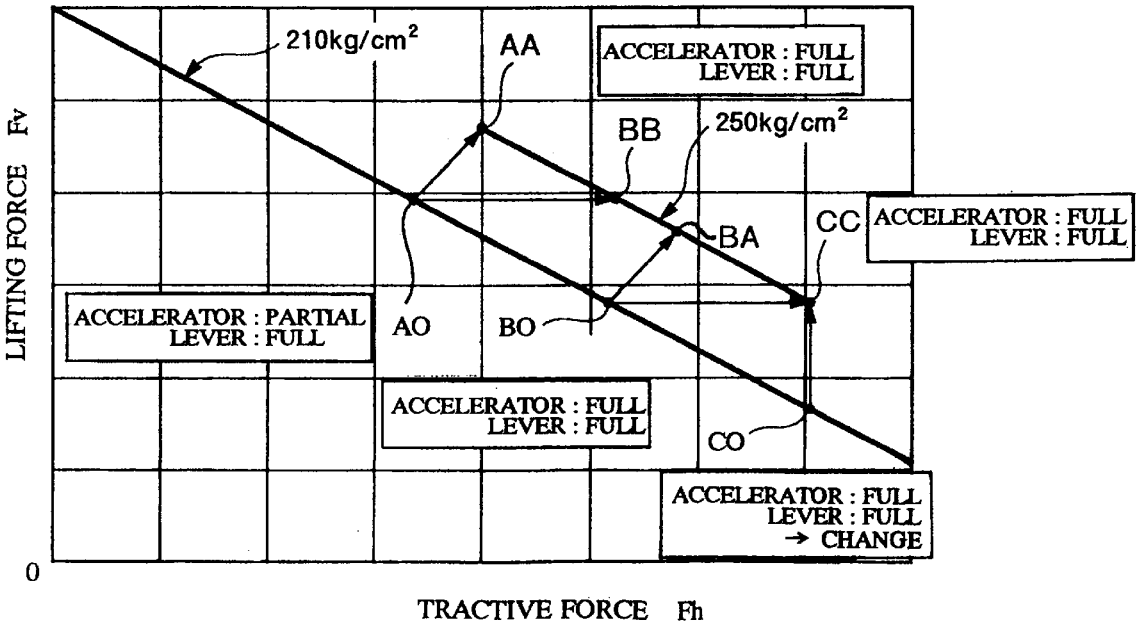
FIG. 6D is a diagram showing the relationship between tractive force and lifting force at the bucket edge at the time of excavation according to the first embodiment of the present invention.
Figure 7:
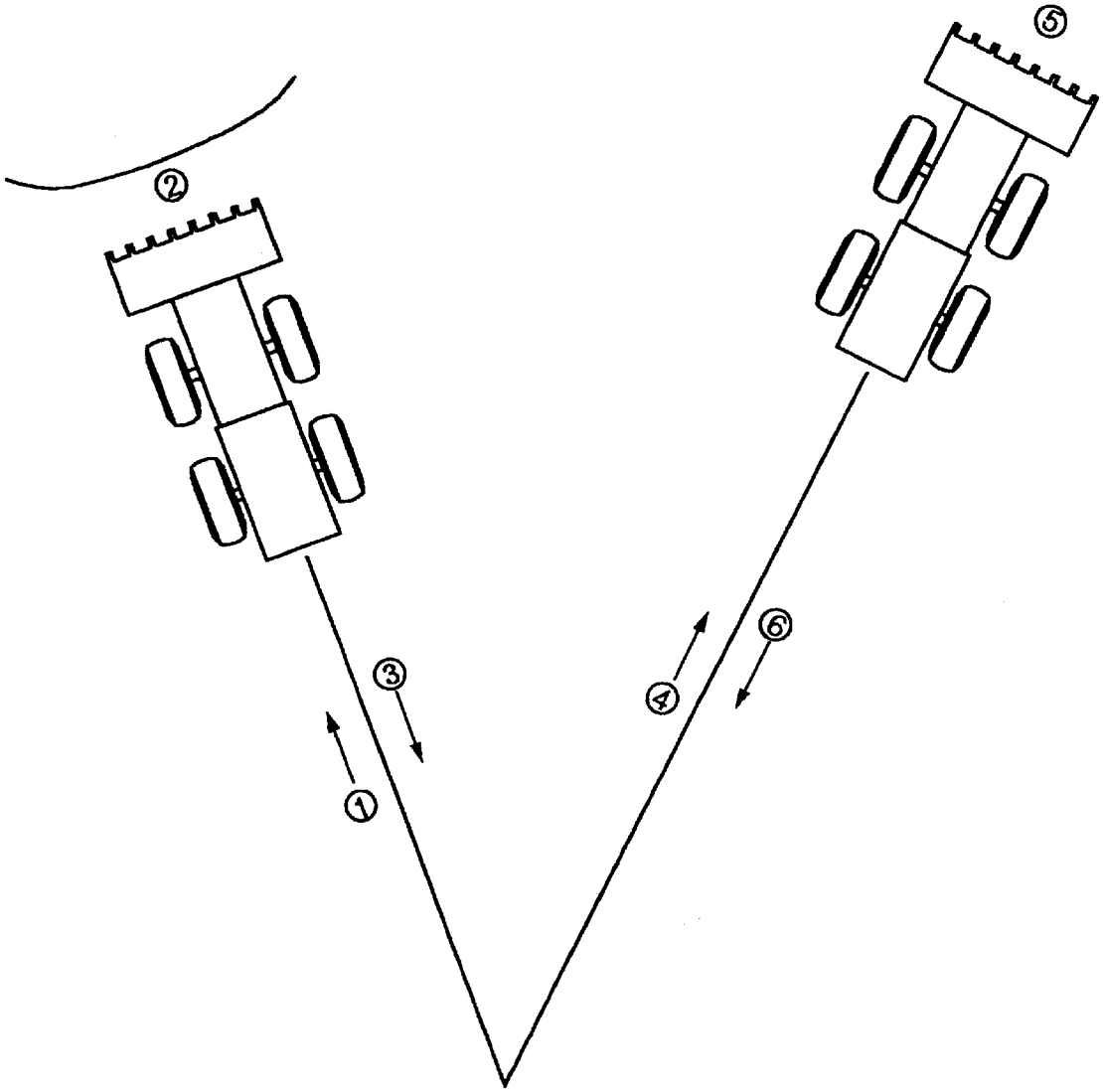
FIG.7 PRIOR ART
FIG. 7 is a diagram showing a common V shaped loading operation.
Figure 9:
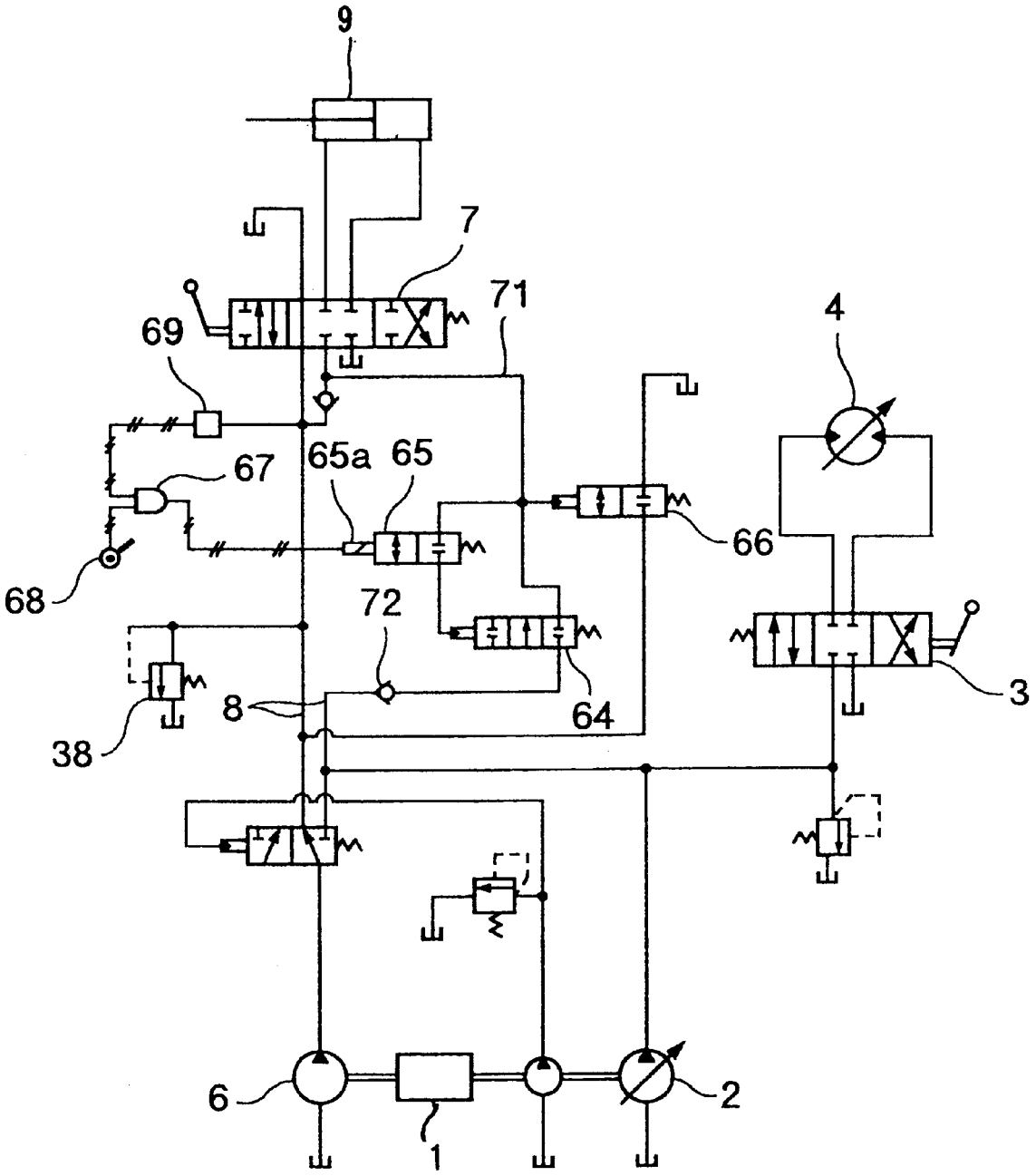
FIG.9 PRIOR ART
FIG. 9 is an oil hydraulic circuit diagram in a first prior art.

Incidentally, at a point C0, where the lifting force Fv is small as shown in FIGS. 6C and 6D, it is set to move from the point C0 to the point CC so as to increase the lifting force Fv by conducting the full operation again by closing the pouring command switch 14 after returning the boom operating lever from the full operation to the neutral position.

Figure 2:
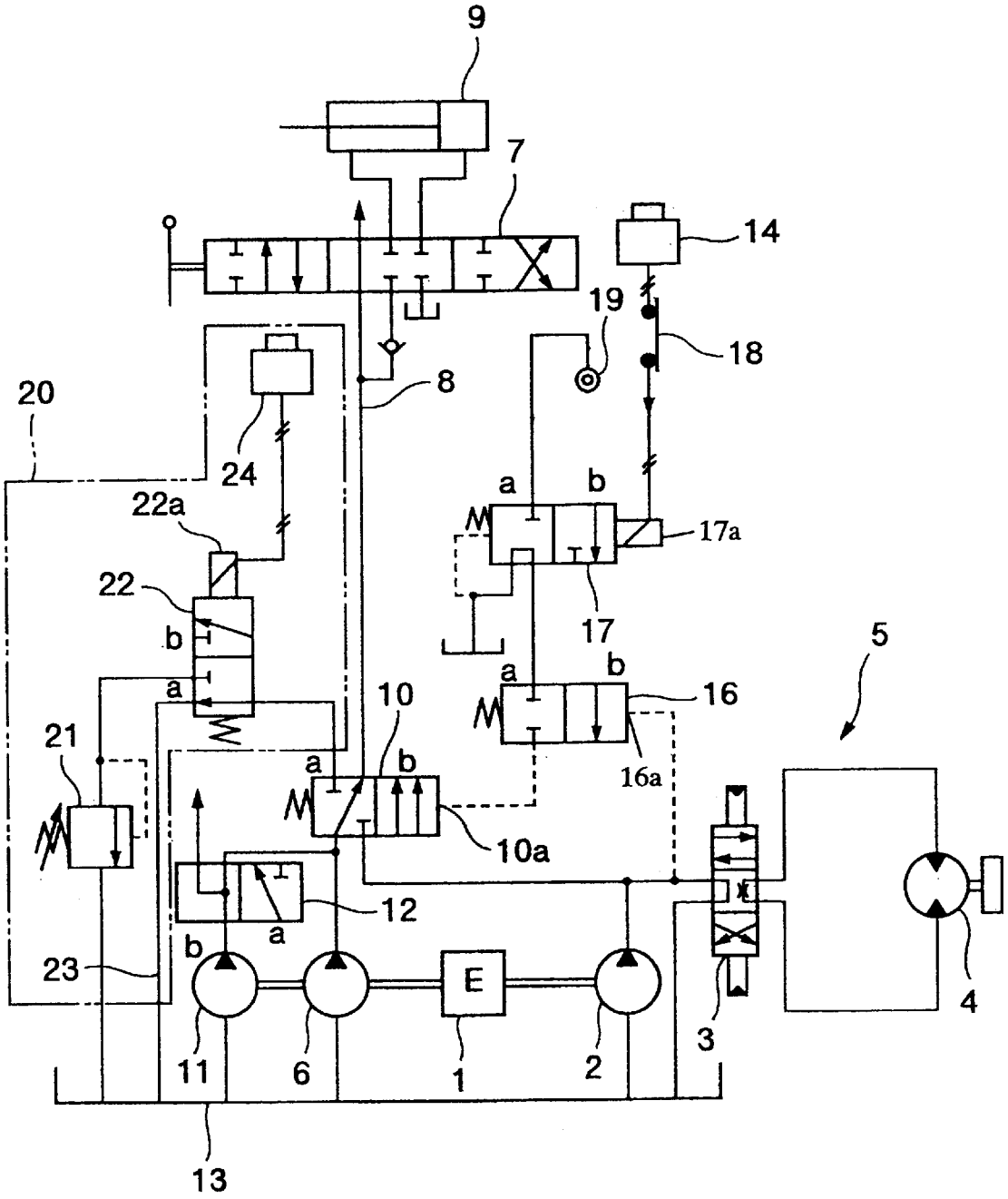
FIG. 2 is an oil hydraulic circuit diagram showing a second embodiment of the hydraulic drive type vehicle according to the present invention.

As compared with the first embodiment, a second embodiment, shown in FIG. 2, (a) changes the pilot pressure source of the pilot pressure receiving portion 10*a* of the pouring changeover valve 10 from the working machine hydraulic circuit 8 to a different oil pressure source 19, and (b) omits the controller 25, the sensor 26, the electric circuit 27, and the line 27*a*. It has a configuration in which the operator manually opens and closes the pouring releasing means (switch) 18.

Figure 3:
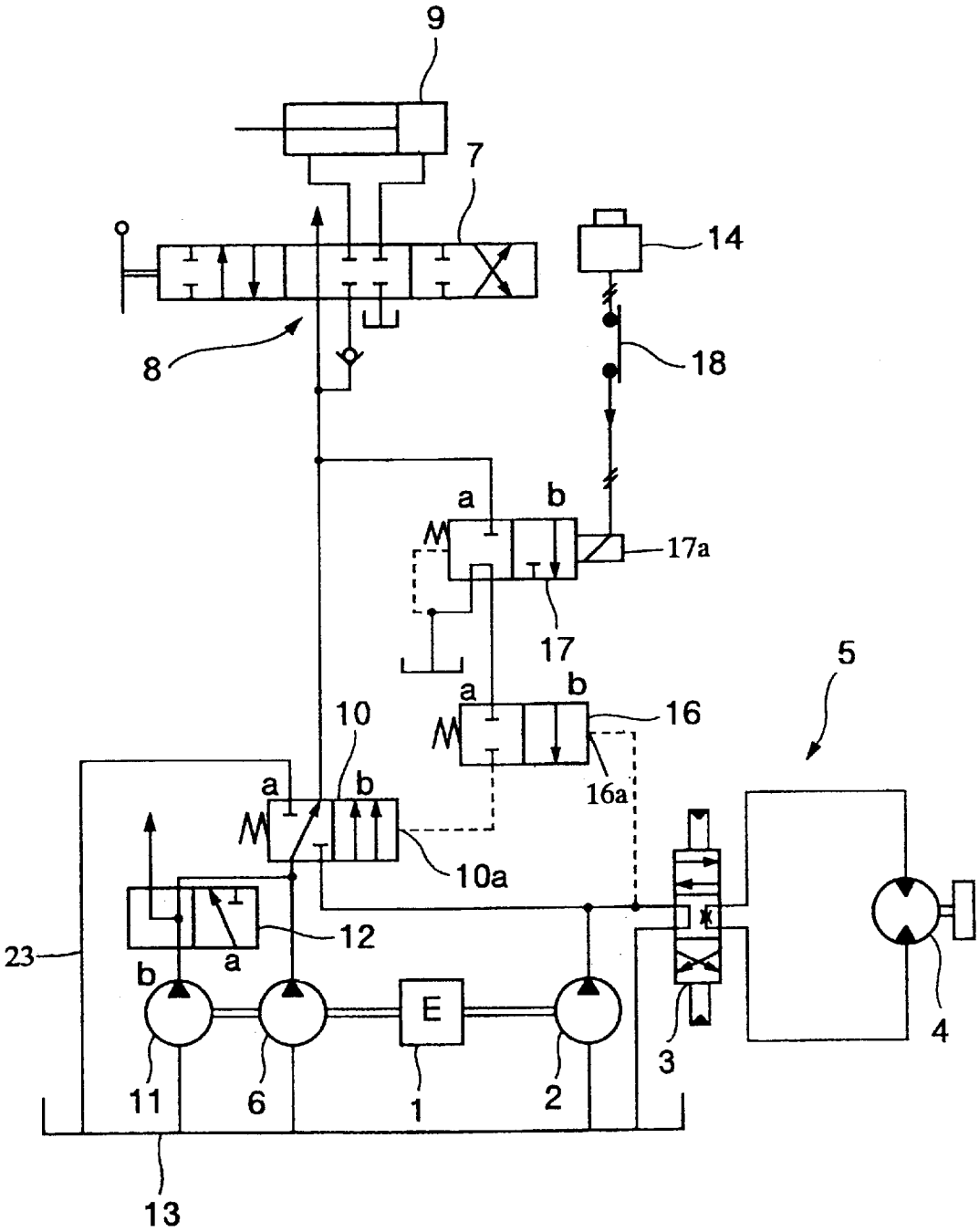
FIG. 3 is an oil hydraulic circuit diagram showing a third embodiment of the hydraulic drive type vehicle according to the present invention.

As compared with the first embodiment, a third embodiment, shown in FIG. 3, (a) omits the load adjusting means 20, (b) connects the pouring changeover valve 10 to the drain line 23, and (c) omits the controller 25, the sensor 26, the electric circuit 27, and the line 27*a*. It has a configuration in which the operator manually opens and closes the pouring releasing means (switch) 18.

Reasonable variation and modifications are possible within the scope of the foregoing description, the drawings, and the appended claims to the invention.

We claim:

1. A hydraulic drive working vehicle comprising:

a working machine;

a travel hydraulic circuit for traveling the vehicle;

a working machine hydraulic circuit for driving the working machine and for receiving, into said working machine hydraulic circuit, pressurized oil of said travel hydraulic circuit having a pressure which exceeds a pressure of oil of said working machine hydraulic circuit;

a pilot pressure source;

a pouring changeover valve, having a first pilot pressure receiving portion for receiving a pilot pressure from said pilot pressure source; said pouring changeover valve being switchable between (a) a pouring position, wherein pressurized oil of said travel hydraulic circuit is poured into said working machine hydraulic circuit, and (b) a shutoff position, wherein said travel hydraulic circuit and said working machine hydraulic circuit are isolated from each other;

a first changeover valve, disposed between said pilot pressure source and said first pilot pressure receiving portion, said first changeover valve having a second pilot pressure receiving portion for receiving pressurized oil of said travel hydraulic circuit and being switchable from its shutoff position to its communicating position when oil pressure of said travel hydraulic circuit exceeds a predetermined oil pressure;

a pouring command switch; and a second changeover valve, connected with said first changeover valve in series between said pilot pressure source and said first pilot pressure receiving portion, said second changeover valve having a solenoid portion, said second changeover valve being switchable from its shutoff position to its communicating position upon receipt, at said solenoid portion, of a pouring command from said pouring command switch; and wherein said pouring changeover valve is switchable to its pouring position when the oil pressure of said travel hydraulic circuit exceeds the predetermined oil pressure and the pouring command is outputted.

2. A hydraulic drive type working vehicle in accordance with claim 1, further comprising a pouring releasing means, disposed between said pouring command switch and said solenoid portion, for interrupting the pouring command during operation of said working machine.

3. A hydraulic drive type working vehicle in accordance with claim 2, wherein an operation of said working machine is at least one of (a) a tilting operation of a bucket, which is provided on said working machine, and (b) an operation of returning a boom operating lever of said working machine to a neutral position.

4. A hydraulic drive type working vehicle in accordance with claim 3, further comprising:

a sensor, for detecting at least one of a bucket tilting operation and an operation of returning the boom operating lever to the neutral position; and a controller, for inputting a signal from said sensor and for outputting, to said pouring releasing means, a signal for interrupting the pouring command.

5. A hydraulic drive type working vehicle comprising:

a working machine;

a travel hydraulic circuit for traveling the vehicle and a working machine hydraulic circuit for driving the working machine and for receiving, into said working machine hydraulic circuit, pressurized oil of said travel hydraulic circuit having a pressure which exceeds a pressure of oil of said working machine hydraulic circuit;

a working machine pump, for discharging oil into said working machine hydraulic circuit;

a travel pump, for discharging oil into said travel hydraulic circuit;

a load adjusting means, for setting a pressure of oil discharged from said working machine pump at a predetermined condition in a range from an unload condition to an optional load condition, and for setting driving torque of said travel pump at a predetermined value; and a pouring changeover valve, which is switchable between (a) a pouring position, wherein oil of said working machine pump is discharged into said load adjusting means and pressurized oil of said travel hydraulic circuit is poured into said working machine hydraulic circuit, and (b) a shutoff position, wherein oil of said working machine pump is discharged into said working machine hydraulic circuit and wherein said travel hydraulic circuit and said working machine hydraulic circuit are isolated from each other.

6. A hydraulic drive type working vehicle in accordance with claim 5, wherein said load adjusting means includes:

a load means for allowing a pressure of oil discharged from said working machine pump to be set at an optional load;

a load changeover valve, which is switchable between a load position, wherein said working machine pump is connected to said load means, and an unload position, wherein said working machine pump is unloaded; and a mode selecting switch for outputting a switching command for switching said load changeover valve to its load position.

7. A hydraulic drive type working vehicle in accordance with claim 6, wherein said load means allows a load condition in a range, from an unload condition to a predetermined load condition, to be set continuously.

8. A hydraulic drive type working vehicle in accordance with claim 6, wherein said load means allows a load condition, in a range from an unload condition to a predetermined load condition, to be set at predetermined steps.

* * * * *